US007485019B1

(12) United States Patent
Macier et al.

(10) Patent No.: US 7,485,019 B1
(45) Date of Patent: Feb. 3, 2009

(54) MOLDED MOTOR SILENCING SYSTEM HAVING A VIBRO-ACOUSTIC MATERIAL

(75) Inventors: James F. Macier, Beach Park, IL (US); George L. Broughton, Wadsworth, IL (US); Evelyn A. Breznik, Waukegan, IL (US)

(73) Assignee: BRP US Inc., Sturtevant, WI (US)

( * ) Notice: Subject to any disclaimer, the term of this patent is extended or adjusted under 35 U.S.C. 154(b) by 154 days.

(21) Appl. No.: 10/708,085

(22) Filed: Feb. 6, 2004

(51) Int. Cl.

| | |
|---|---|
| ***B63H 20/00*** | (2006.01) |
| ***B63H 20/32*** | (2006.01) |
| ***B63H 21/36*** | (2006.01) |
| ***F02B 77/13*** | (2006.01) |

(52) U.S. Cl. ..... 440/76; 440/77; 181/204

(58) Field of Classification Search ..... 440/76, 440/77, 78; 123/195 C, 195 P; 181/198, 181/204, 205

See application file for complete search history.

(56) References Cited

U.S. PATENT DOCUMENTS

| | | | | |
|---|---|---|---|---|
| 2,890,674 | A * | 6/1959 | Rose | 440/52 |
| 2,971,507 | A * | 2/1961 | Kiekhaefer | 123/198 E |
| 3,002,489 | A * | 10/1961 | Watkins | 440/52 |
| 3,090,463 | A * | 5/1963 | Yanda | 440/52 |
| 3,195,530 | A * | 7/1965 | Heidner | 181/204 |
| 4,723,926 | A * | 2/1988 | Uehara | 440/52 |
| 5,215,485 | A * | 6/1993 | Bonner et al. | 440/77 |
| 5,306,184 | A * | 4/1994 | Nakayama | 440/89 R |
| 5,954,022 | A * | 9/1999 | Katayama et al. | 440/89 R |
| 6,358,106 | B1 * | 3/2002 | Herrera | 440/77 |
| 6,419,535 | B1 * | 7/2002 | Herrera | 440/77 |
| 6,419,537 | B1 * | 7/2002 | House et al. | 440/88 R |
| 6,875,066 | B2 * | 4/2005 | Wolaver | 440/77 |

FOREIGN PATENT DOCUMENTS

| | | | |
|---|---|---|---|
| CA | 2219750 | A1 * | 4/1999 |
| JP | 05246390 | A * | 9/1993 |
| JP | 05270489 | A * | 10/1993 |

* cited by examiner

*Primary Examiner*—Ajay Vasudeva
(74) *Attorney, Agent, or Firm*—Osler, Hoskin & Harcourt LLP

(57) ABSTRACT

An apparatus and method for silencing an engine are disclosed. A silencer is disposed about a motor and is molded to substantially match at least one of a contour of the cover and a contour of the motor to silence noise transmitted from the motor.

32 Claims, 10 Drawing Sheets

FIG. 13
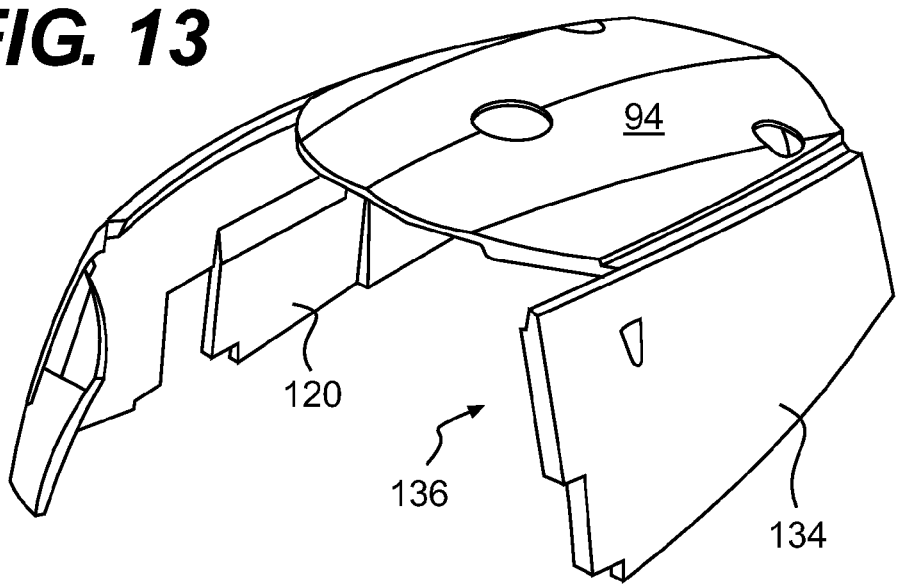
FIG. 14
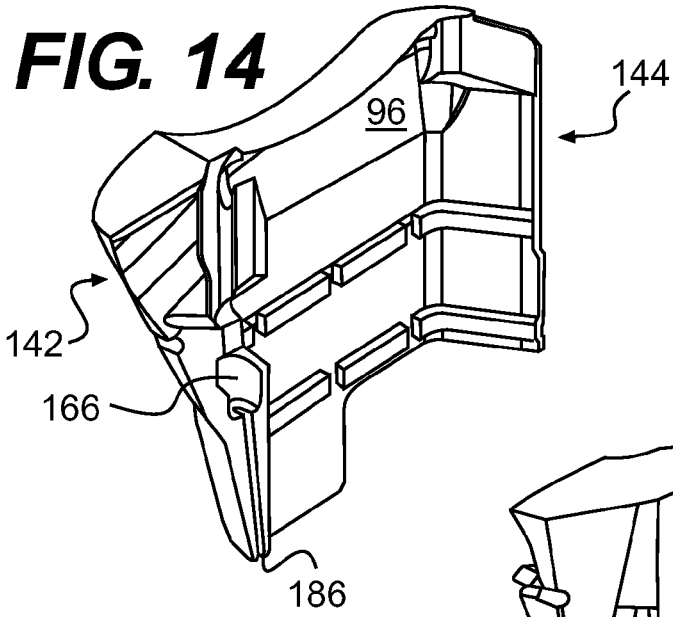
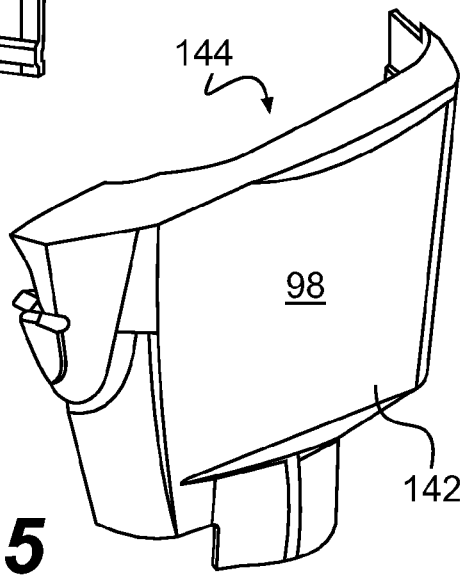
FIG. 15

MOLDED MOTOR SILENCING SYSTEM HAVING A VIBRO-ACOUSTIC MATERIAL

BACKGROUND OF INVENTION

The present invention relates generally to outboard motors and other recreational products, and more particularly, to a molded silencer to reduce the transmission of engine noise beyond a housing positioned about the engine.

The present invention is applicable to both two-cycle, or two-stroke, and four-stroke engines. The combustion process of the engine generates noise that transfers, in part, directly through components of the engine. That is, during the combustion process, noise associated with the combustion, as well as the combustion impact on the internal surfaces in the combustion chamber, transfers through the engine components and is audible therebeyond. In addition to the noise that transmits through the components of the engine, engine noise can also exit the engine along the gas paths to and from the combustion chamber. That is, the air intake system provides combustion gas to the engine while an exhaust gas system provides the discharge path for the combustion process exhaust gases. Noise can carry on these gas paths and ultimately exit the engine. This noise is occasionally trapped in a volume of space between the engine and the housing and reverberates therein resulting in inadvertent amplification of the engine noise. Ultimately, the engine noise either transmits directly through the housing or exits the housing via openings therein.

Noise generated by an outboard motor, for example, can be a distraction to an otherwise well-performing engine. Additionally, a quieter operating engine that eliminates any noise is generally advantageous. Many efforts have been made to create a quieter operating engine. A muffler is often implemented on an exhaust side of an engine and air intake silencers have been implemented on an intake side of the engine to "muffle" noise transmitted along the gas paths to and from an engine. Additionally, attempts have been made to lessen the amount of general engine noise emitted directly through the housing positioned about the engine.

Known methods of silencing this general engine noise include positioning a rigid housing or cover about the engine with sound directing openings therethrough. These sound directing openings generally direct the noise of the engine away from an operator but do little to reduce the total amount of noise emitted from the motor. In an effort to further decrease the engine noise transmitted through the housing, foam inserts have been cut and glued into cavity spaces that exist between the components of the engine and the housing. This type of engine silencing is time consuming to implement and only marginally effective at silencing the general noise emitted from the engine. Additionally, over time, the foam inserts and the adhesives used to glue them into place can become damaged or degraded thereby reducing the ability of the foam inserts to attenuate noise.

It would therefore be desirable to have a system and method capable of more efficiently silencing an engine.

BRIEF DESCRIPTION OF INVENTION

The present invention provides a silencer and method of silencing an outboard motor that solves the aforementioned problems. The silencer is molded substantially to the shape of a volume between an engine and the cover. Such a construction provides a one-piece molded silencer that absorbs, confines, and directs noise emitted from the engine.

Therefore, in accordance with one aspect of the present invention, a motor silencer is disclosed that includes a molded composition having a first surface and a second surface. The first surface has a contour that substantially matches a contour of a cover of the motor and the second surface has a contour that conforms about internal components of the motor. Such a construction forms a motor silencer that absorbs noise generated by the motor.

According to another aspect of the present invention, an outboard motor is disclosed which includes a midsection having at least one midsection cover. The midsection cover has a first contour defining a first volume between the midsection and the midsection cover. A first silencer fills a majority of the first volume. A second silencer is disposed in a second volume between an engine and an engine cover and is molded to substantially match a contour of the cover. Such a construction prevents a majority of the noise generated by the engine during operation from passing beyond the covers.

In accordance with a further aspect of the present invention, a method of silencing an outboard motor includes providing a housing having a cover and at least one lower unit cover each being engagable on an outboard motor and providing a silencer molded to substantially match the shape of the cover and constructed to absorb sound emitted from the motor.

In accordance with another aspect of the present invention, an outboard motor is disclosed that includes an engine attached to a midsection. A cover is disposed about the engine and encloses a volume therebetween. A vibro-acoustic treatment is disposed within the volume and molded to substantially match a shape of the volume. Such a construction provides an outboard motor with minimal noise transmission therefrom.

In accordance with yet a further aspect of the present invention, an outboard motor is disclosed having an upper motor cover disposed about an engine and a lower motor cover disposed about a midsection and forming a volume therebetween. A molded lower silencer having a shape that substantially matches a shape of the volume is disposed therein. Such a construction minimizes the transmission of noise emitted from the midsection beyond the lower motor cover.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings:

FIGS. 13-15 are perspective views of the vibro-acoustic treatments shown in FIG. 6 of the outboard motor of FIG. 1.

DETAILED DESCRIPTION

Figure 1:
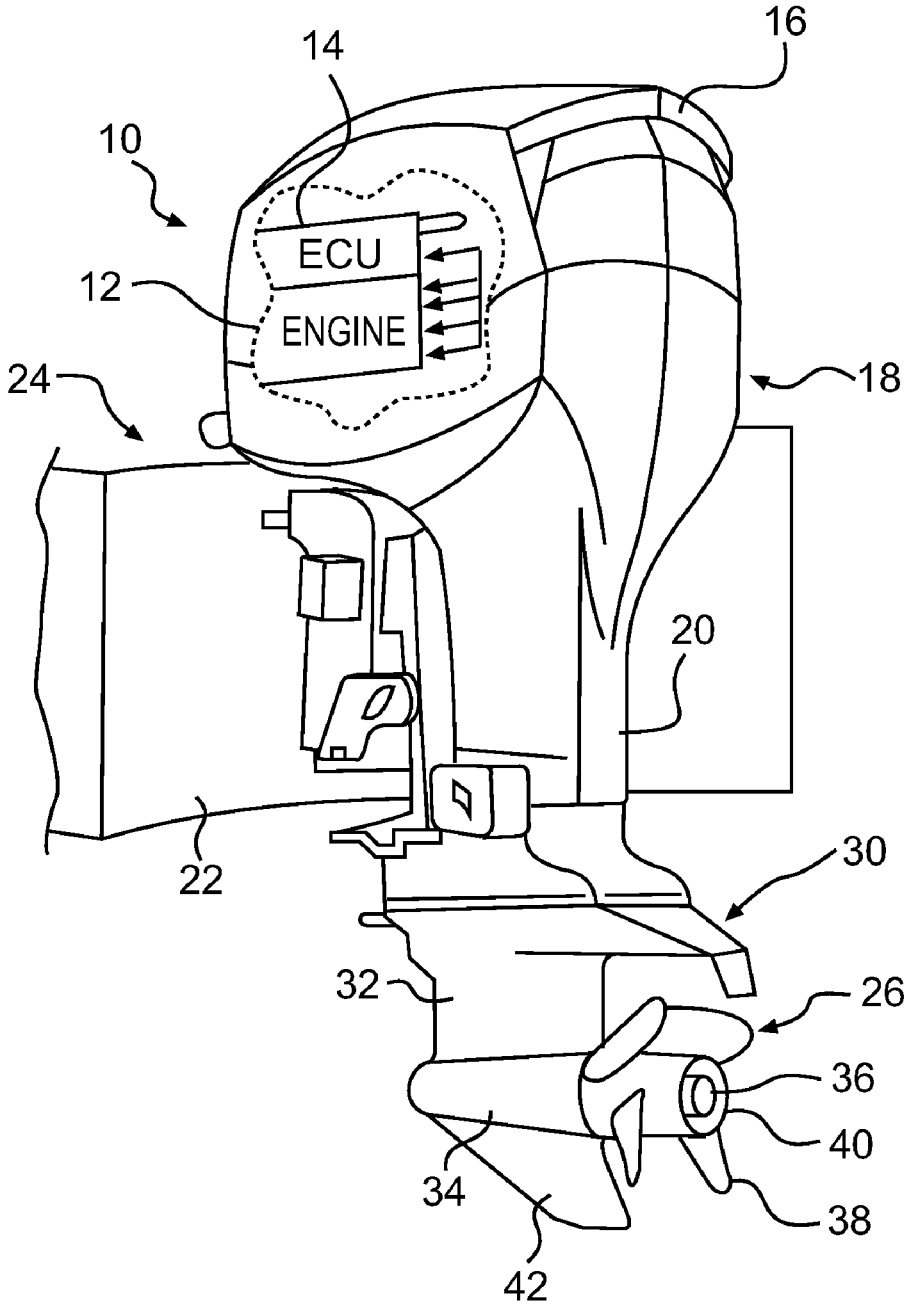
FIG. 1 is a perspective view of an exemplary outboard motor incorporating the present invention.

The present invention relates generally to outboard motors, and other recreational products. FIG. 1 shows an outboard motor 10 having direct fuel injection in a spark-ignited two-stroke gasoline engine 12 controlled by an electronic control unit (ECU) 14 under an engine cover, or upper motor cover 16. Engine 12 is housed generally in a powerhead 18 and is supported on a midsection 20 configured for mounting on a transom 22 of a boat 24 in a known conventional manner. Engine 12 is coupled to transmit power to a propeller 26 to develop thrust and propel boat 24 in a desired direction. A lower unit 30 includes a gear case 32 having a bullet or torpedo section 34 formed therein and housing a propeller shaft 36 that extends rearwardly therefrom. Propeller 26 is driven by propeller shaft 36 and includes a number of fins 38 extending outwardly from a central hub 40 through which exhaust gas from engine 12 is discharged via midsection 20. A skeg 42 depends vertically downwardly from torpedo section 34 to protect propeller fins 38 and encourage the efficient flow of outboard motor 10 through water.

Figure 2:
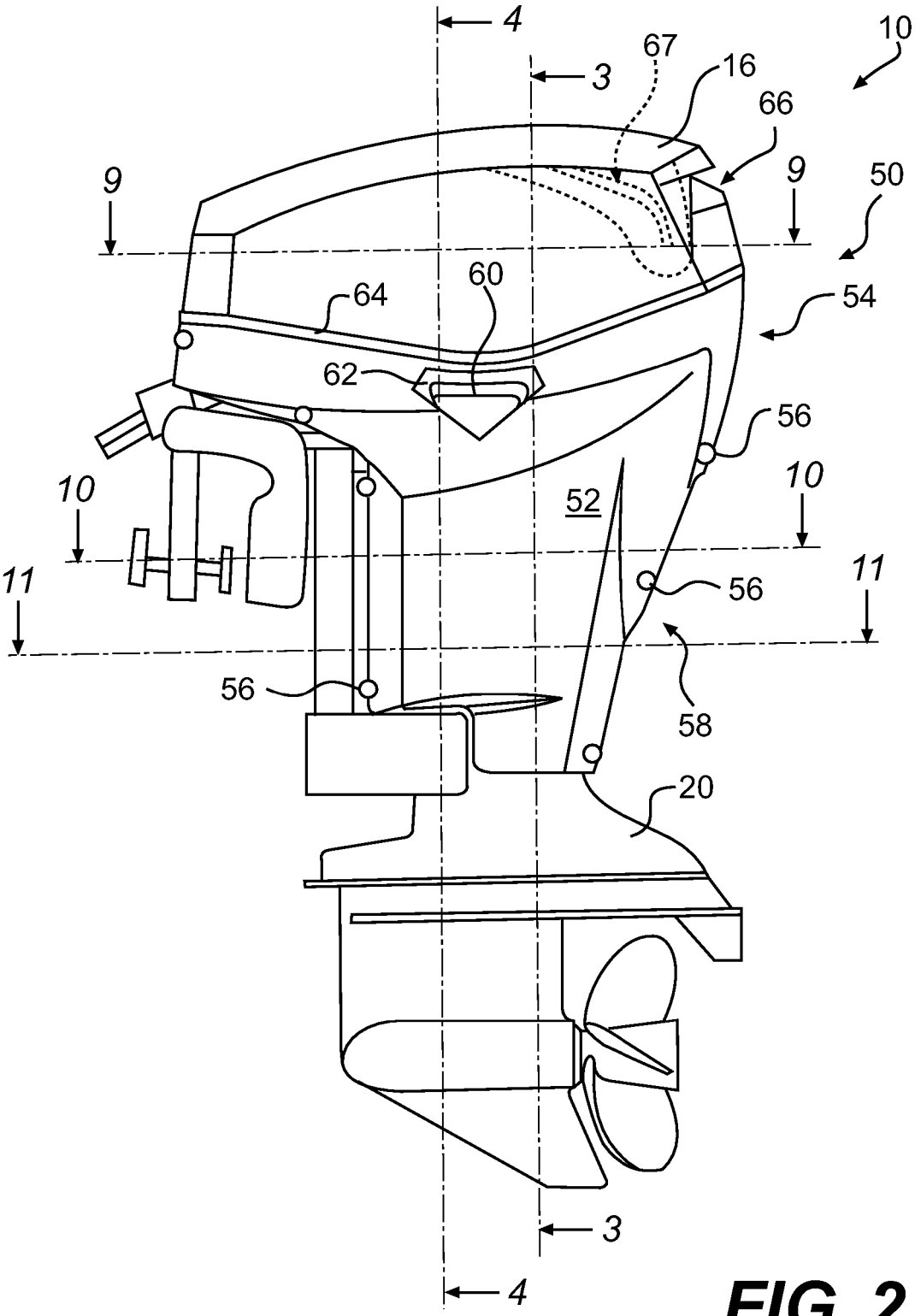
FIG. 2 is an elevational view of the outboard motor of FIG. 1.

Referring to FIG. 2, outboard motor 10 has a housing 50 which includes upper motor cover 16, a first lower motor cover 52, and a second lower motor cover 54. Second lower motor cover 54 is similar in shape to first lower motor cover 52 such that one mates to the other. A plurality of fasteners 56 positioned about a perimeter 58 of first lower motor cover 52 engages second lower motor cover and secures lower motor covers 52, 54 about midsection 20. A latch 60 is located in a recess 62 formed in lower motor covers 52, 54 and secures upper motor cover to lower motor covers 52, 54. A seal 64 extends about the interface of upper motor cover 50 and lower motor covers 52, 54 and restricts fluid communication between the inside of housing 50 and atmosphere.

A recess 66 is formed in an upper portion 68 of upper motor cover 16 and acts as a grab hold for manually tilting motor 10 and removing upper motor cover 16 from motor 10, as well as providing a combustion gas passage into housing 50. Air enters upper motor cover 16 at recess 66, passes along a baffle 67, and is used by the engine of outboard motor 10 during the combustion process. Additionally, recess 66, or the housing air intake opening, is located on upper motor cover 16 facing away from an operator of a watercraft equipped with the motor of the present invention. Such an orientation reduces the operator's exposure to engine noise that may exit housing at recess 66.

Figure 3:
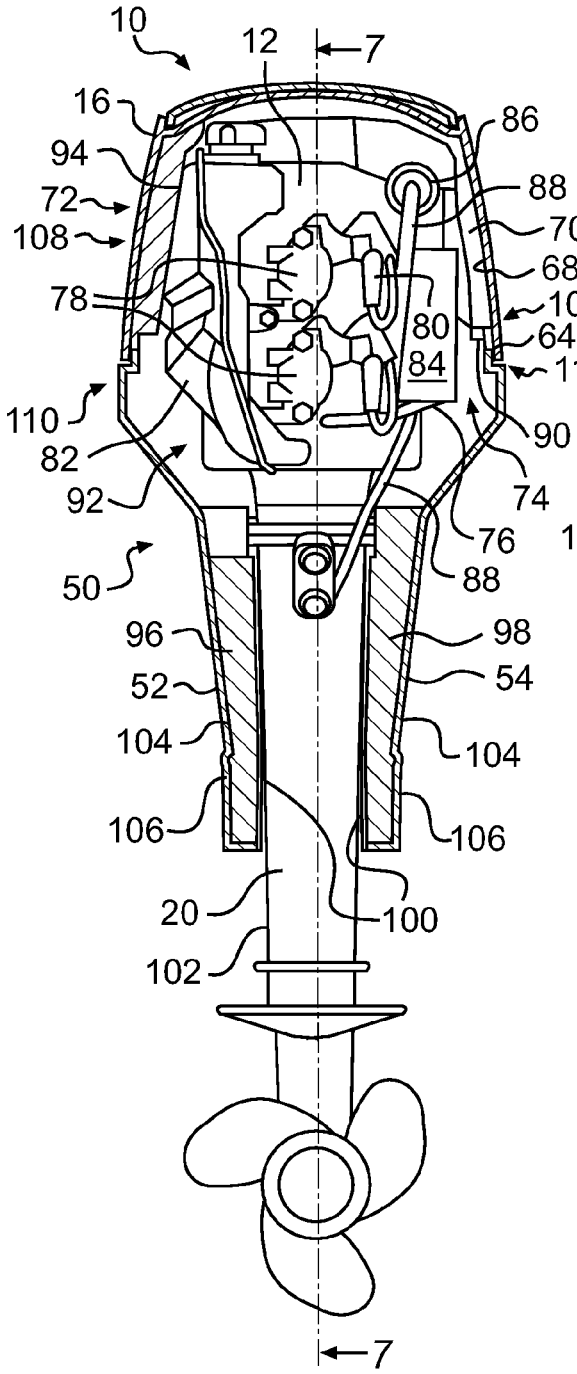
FIG. 3 is a cross-sectional view of the outboard motor of FIG. 1 taken along line 3-3 of FIG. 2.

FIG. 3 shows housing 50 positioned about engine 12 and midsection 20 of outboard motor 10. An engine side 68 of upper motor cover 16 has a contour 70 and is positioned about an upper portion 72 of engine 12 with a gap 74 therebetween. Engine 12 has a contour 76 that roughly matches contour 70 of upper motor cover 16. Contour 70 is a relatively complex shape due, in part, to the interconnection of the different components of engine 12. Some of the components of engine 12 which each individually contribute to total contour of engine 12 include a plurality of injector assemblies 78, a plurality of ignition wires 80, an oil reservoir 82, a fuel vapor separator 84, a fuel filter 86, and a plurality of fuel system hoses 88.

The contour 70 of engine side 68 of upper motor cover 16 is partially formed by a baffle 90 which occupies a portion of gap 74 between upper motor cover 16 and engine 12. Baffle 90 is disposed between engine 12 and housing 50 to allow air for combustion to flow from recess 66, shown in FIG. 2, to gap 74 and therefrom to engine 12. Additionally, baffle 90 directs any water that may inadvertently enter housing 50 at recess 66 toward a lower portion 92 of engine 12. An engine silencer 94 is molded to occupy a majority of the volume that remains between engine contour 76 and engine side 68 of upper motor cover 16.

In much the same way, a first lower silencer 96 and a second lower silencer 98 are molded to be disposed between first and second lower motor covers 52 and 54 and midsection 20, respectively. A midsection side 100 of lower silencers 96, 98 is molded to substantially match a contour 102 of midsection 20 and a housing side 104 of lower silencers 96, 98 is molded to substantially match a contour 106 of lower motor covers 52 and 54, respectively. Lower silencers 96, 98 are snuggly received in the volume between lower motor covers 52, 54 and the midsection thereby reducing the ability of engine noise to propagate therethrough. Seal 64 is disposed between a lower end 108 of upper motor cover 16 and an upper end 110 of lower motor covers 52, 54. The combination of upper motor cover 16 and lower motor covers 52, 54 effectively encapsulate engine 12 and a substantial amount of midsection 20 within housing 50.

It is understood that silencers 94, 96, and 98 form vibro-acoustic treatments about engine 12 and are constructed to not only absorb sound, but also confine and redirect the sound from engine 12 in a direction generally away from an operator of watercraft 10. It is understood that the vibro-acoustic treatments could be constructed from one or a combination of several materials. Foam being only one such material. In addition to absorbing and directing sound, vibro-acoustic treatments 94, 96, and 98 can also be constructed to strengthen the components to which they are connected. Such a construction provides a more rigid structure that has enhanced sound deadening capabilities.

Figure 4:
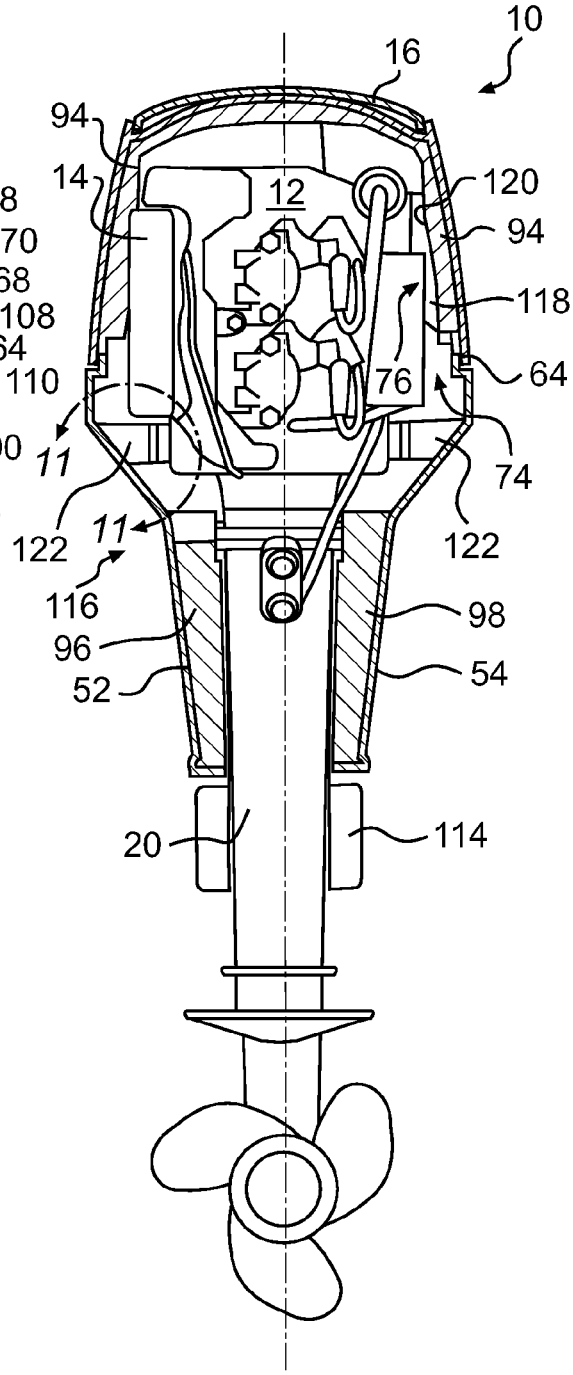
FIG. 4 is a cross-sectional view of the outboard motor of FIG. 1 taken along line 4-4 of FIG. 2.

Looking at FIG. 2, the position of the cross-sectional view of motor 10 shown in FIG. 3 is along the line 3-3 shown in FIG. 2. FIG. 4 is cross-sectional view of motor 10 along line 4-4 shown in FIG. 2. As such, FIG. 4 shows a cross-section of motor 10 further forward than that which is shown in FIG. 3 with distinctions therebetween. Silencer 94 extends about three sides of engine 12 and occupies a majority of gap 74 therebetween. On a port side 116 of motor 10, silencer 94 is positioned in close proximately to ECU 14 thereby reducing the amount of space between upper motor cover 16 and engine 12 not occupied by silencer 94. As shown, both gap 74 and silencer 94 vary in thickness about engine 12.

An unfilled gap 118 extends between an engine side contour 120 of silencer 94 and contour 76 of engine 12. Unfilled gap 118 also varies in thickness and allows upper motor cover 16 with silencer 94 disposed therein to snuggly slide over engine 12 and engage lower motor covers 52, 54. A plurality of indexing posts 122 extends between engine 12 and lower motor covers 52, 54 and positions the lower motor covers relative thereto. A saddle 114 flanks midsection 20 and, in part, supports motor 10 when it is engaged therewith.

Each silencer 94, 96, and 98 is molded from a vibro-acoustic material having a generally interstitial cavity construction. Although it is preferred that each of the silencers has a waterproof construction, the degree of waterproofing can detrimentally affect the ability of the silencers to attenuate engine noise. Additionally, the frequency of the noise to be attenuated varies along the silencers due, in part, to the contouring of the treatments. Each of the silencers can be molded from a vibro-acoustic material having a density range of two pounds per cubic foot to twenty-two pounds per cubic foot. Silencer 94 is preferably molded from a vibro-acoustic material having a density of four pounds per cubic foot when it is located generally above the waterline. Additionally, silencer 94 can be molded with a thin skin on an exterior thereof. The skin is essentially waterproof and does not interfere with the ability of silencer 94 to attenuate engine noise. Silencers 96 and 98 have a higher potential for being exposed to water. Therefore, silencers 96 and 98 are preferably constructed impervious to water penetration and molded from a vibro-acoustic material having a density of approximately fourteen to twenty-two pounds per cubic foot. It is understood that the density of the silencing material is dependent on a preferred amount of attenuation and/or to provide a desired water resistivity. The examples above are only examples and in no way limit of the claims included herein.

Figure 5:
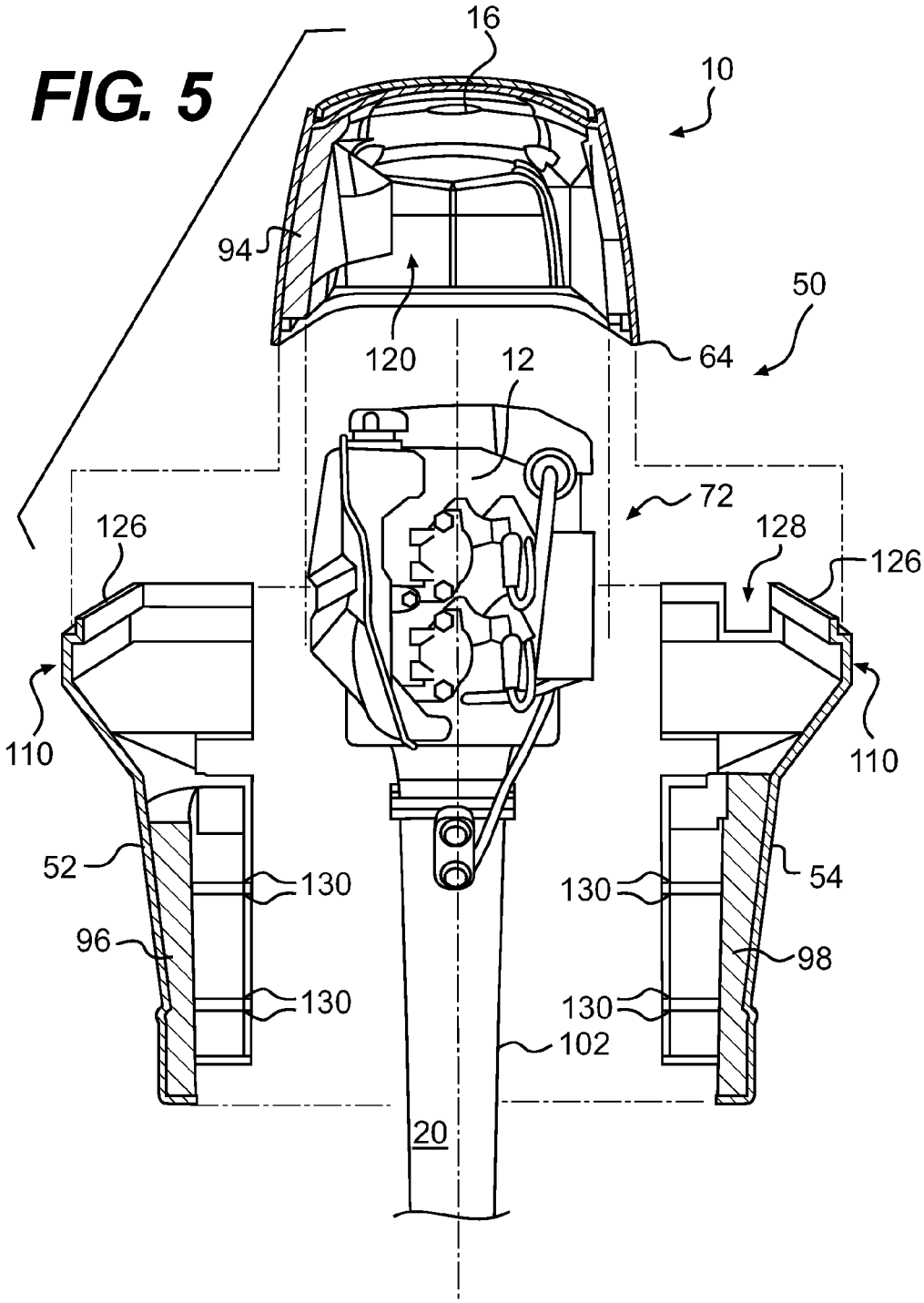
FIG. 5 is a partially exploded view of the outboard motor of FIG. 3 with the housing assembly exploded therefrom.

FIG. 5 shows motor 10 with housing 50 removed therefrom. Silencer 94 is positioned snuggly in upper motor cover 16. Engine side contour 120 of silencer 94 is constructed to snuggly engage an upper portion 72 of engine 12. Seal 64 is positioned about a perimeter 124 of upper motor cover 16 and is constructed to align with a lip 126 formed at upper end 110 of lower motor covers 52, 54. Lower motor cover 54 has a notch 128 formed at upper end 110 to allow passage of connections therethrough. Such connections can include fuel lines, power cables, and engine control lines. Lower silencers 96, 98 have a plurality of ribs 130 formed in midsection side 100 of lower silencers 96 and 98. Ribs 130 extend from midsection side 100 and are constructed to snuggly engage contour 102 of midsection 20. When lower motor covers 52, 54 are attached to engine 12, ribs 130 of lower silencer 96 and lower silencer 98 are generally aligned and extend circumferentially about midsection 20.

Figure 6:
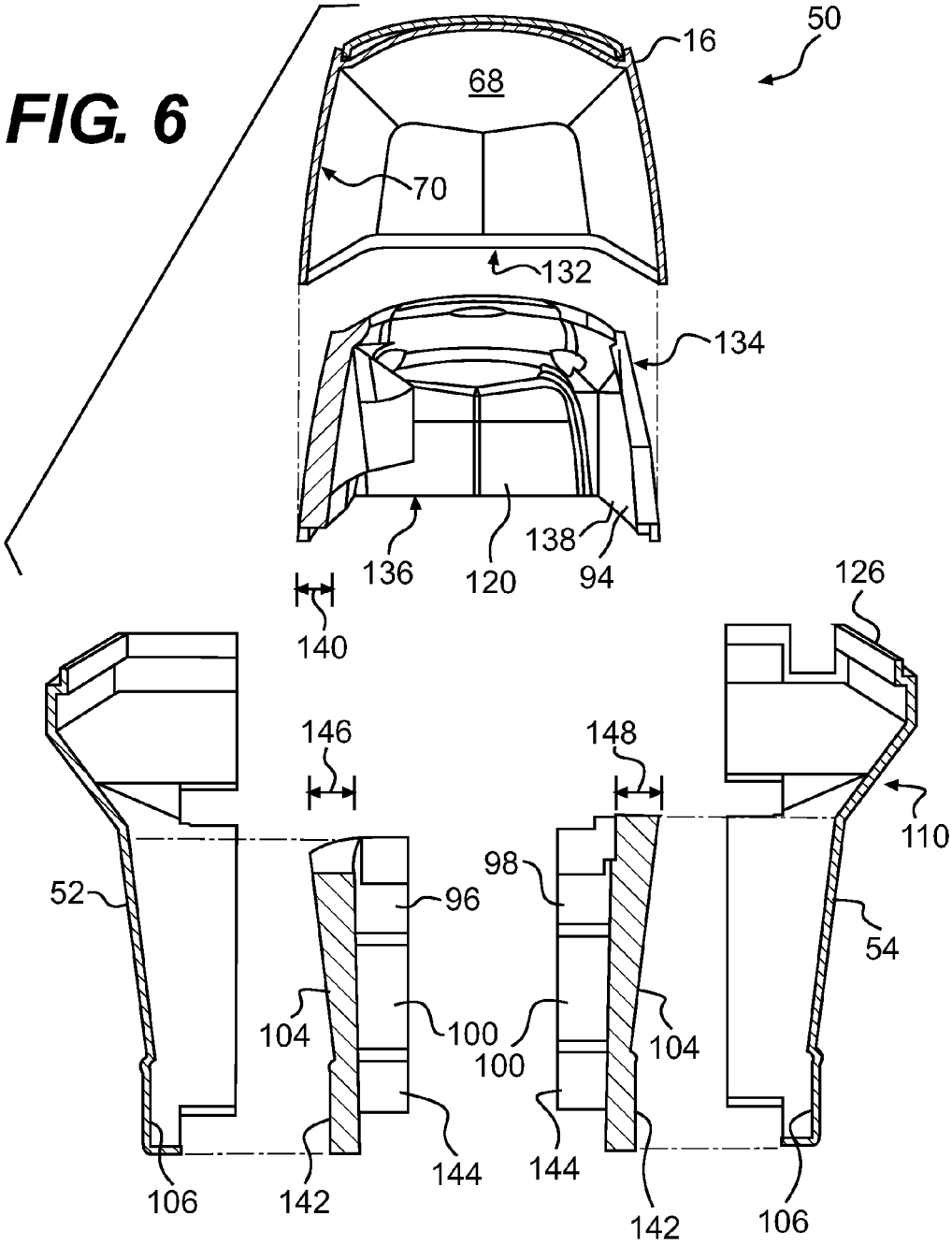
FIG. 6 is the housing assembly of FIG. 5 with the vibro-acoustic treatments exploded therefrom.

Silencers 94, 96, and 98 are shown in FIG. 6 removed from covers 16, 52, and 54 of housing 50. Upper motor cover 16 has a recess 132 formed therein with engine side 68 exposed thereto. Contour 70 of upper motor cover 16 substantially matches a cover side contour 134 of silencer 94 such that silencer 94 is snuggly received by recess 132. Silencer 94 has a recess 136 formed therein and is constructed to receive an engine therein. Contour 120 of an engine side 138 of silencer 94 substantially matches a contour of an engine disposed therein such that silencer 94 is positioned snuggly about the engine. Silencer 94 has a thickness 140 that is variable about the silencer thereby allowing silencer 94 to compensate for differences between the contour of the engine and the cover disposed thereabout.

Contour 106 of lower motor covers 52, 54 substantially matches a contour 142 of housing side 104 of lower silencers 96 and 98, respectively. Midsection side 100 of silencers 96, 98 each has a contour 144 that substantially matches a contour of a midsection disposed thereagainst. Silencers 96, 98 each have a thickness 146 and 148 that varies along the silencers. Thicknesses 146 and 148 accommodate variations in contour 106 of lower motor covers 52 and 54 and the contour of a midsection disposed therein such that silencers 96 and 98 occupy a majority of the space therebetween.

Figure 7:
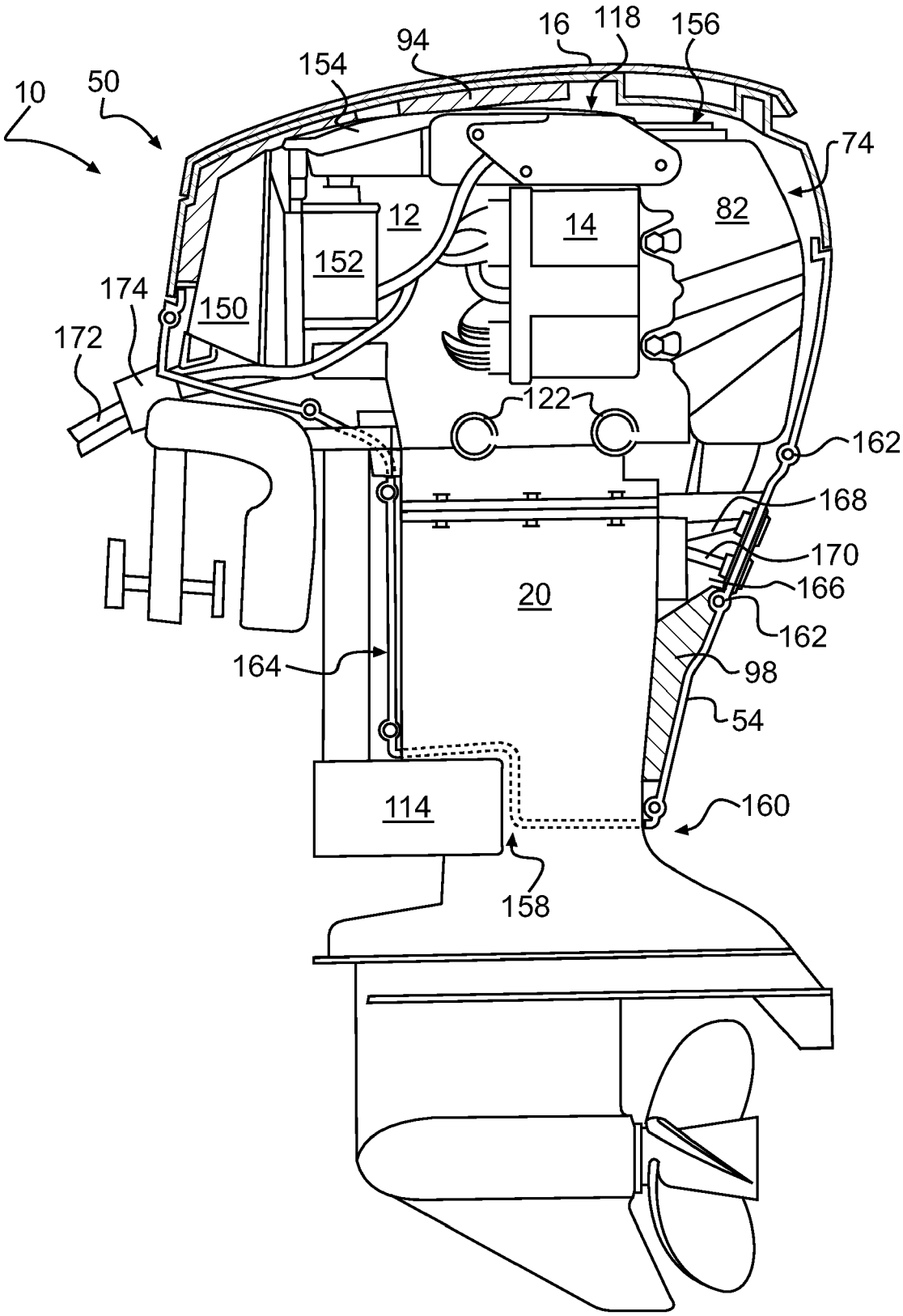
FIG. 7 is a cross-sectional view of the outboard motor of FIG. 1 taken along line 7-7 of FIG. 3.

As shown in FIG. 7, an air intake 150 is connected to engine 12 and allows passage of combustion gas thereinto. A starter 152 is attached to engine 12 and engages a flywheel (not shown) during starting of engine 12. A shroud 154 is disposed between the flywheel and silencer 94 to reduce contact therebetween. Gap 118 between silencer 94 and engine 12 is variable and, in part, dependant on the amount of cooling the adjacent engine components require, movement of adjacent engine components, operating temperature of the components, contour of adjacent components, and engine noise generated in the vicinity of the gap. There are some portions 156 of gap 74 between upper motor cover 16 contour 76 of engine 12 that are unoccupied by silencer 94. Portions 156 are positioned adjacent generally aft portions of engine 12 and are located in areas of gap 74 where reduced amounts of engine noise are present.

Saddle 114 is received in a notch 158 formed in a lower portion 160 of lower cover 54 and silencer 98. A plurality of recesses 162 is formed in a perimeter 164 of lower cover 54 and constructed to engage fasteners that pass through a plurality of bosses formed in the first lower cover thereby connecting the covers together about midsection 20. Lower silencer 98 has a recess 166 formed therein to accommodate an idle relief muffler 168 disposed between midsection 20 and cover 54. A tell-tale 170 vents a cooling system of engine 12 through cover 54 to atmosphere and indicates to an operator circulation of cooling fluid through engine 12. Indexing posts 122 extend from port and starboard sides of engine 12 and located covers 52 and 54 relative thereto. The relation of covers 52 and 54 to indexing posts 122 is discussed further below in reference to FIG. 12.

A plurality of connection lines 172 extends through housing 50 and has a grommet 174 disposed thereabout. Connection lines 172 pass through notch 128 in lower cover 54, as shown in FIG. 5. Returning to FIG. 7, connection lines 172 can include fuel supply lines, ECU communication cables, and throttle control cables. Grommet 174 sealingly extends about connection lines 172 and is constructed to be sealingly disposed in notch 128. Such a construction allows operator interaction with engine 12 without sacrificing water and sound tightness of housing 50.

Figure 8:
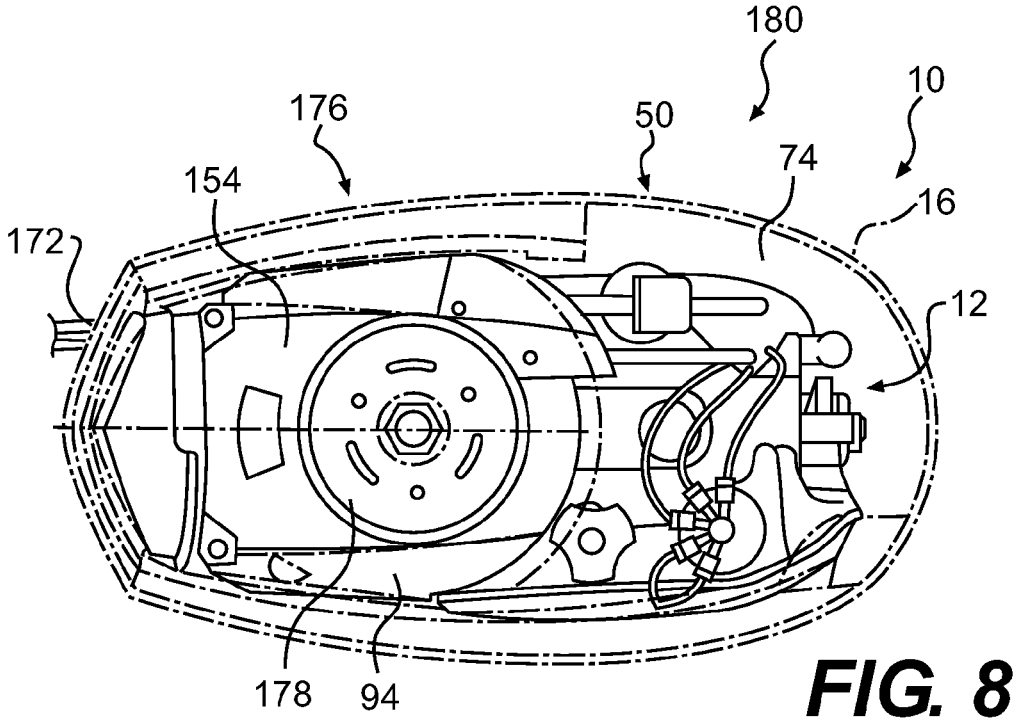
FIG. 8 is a cross-sectional view of the outboard motor of FIG. 1 taken along line 9-9 of FIG. 2 with the housing assembly shown in phantom.

FIG. 8 shows motor 10 with engine 12 disposed in upper motor cover 16 of housing 50 (shown in phantom). Silencer 94, shown in phantom, passes over a forward upper portion 176 of engine 12 adjacent air intake 150 and shroud 154. A flywheel 178 is rotatably connected to engine 12 and smoothes the operation thereof as well as contributing to the starting process of engine 12. Gap 74 between upper motor cover 16 and engine 12 is unobstructed by silencer 94 in an aft upper portion 180 of motor 10. It is understood that silencer 94 could be extended entirely within cover 16 in the aft upper portion of motor 180. Baffle 67, as shown in FIG. 2, is positioned proximate aft upper portion 180 and provides a sound directing passage from engine 12. This area is directed generally away from an operator of a watercraft equipped with the outboard motor of the present invention. Therefore, any engine noise that may resonate in this gap is directed away from an operator and therefore, is generally un-perceived.

Figure 9:
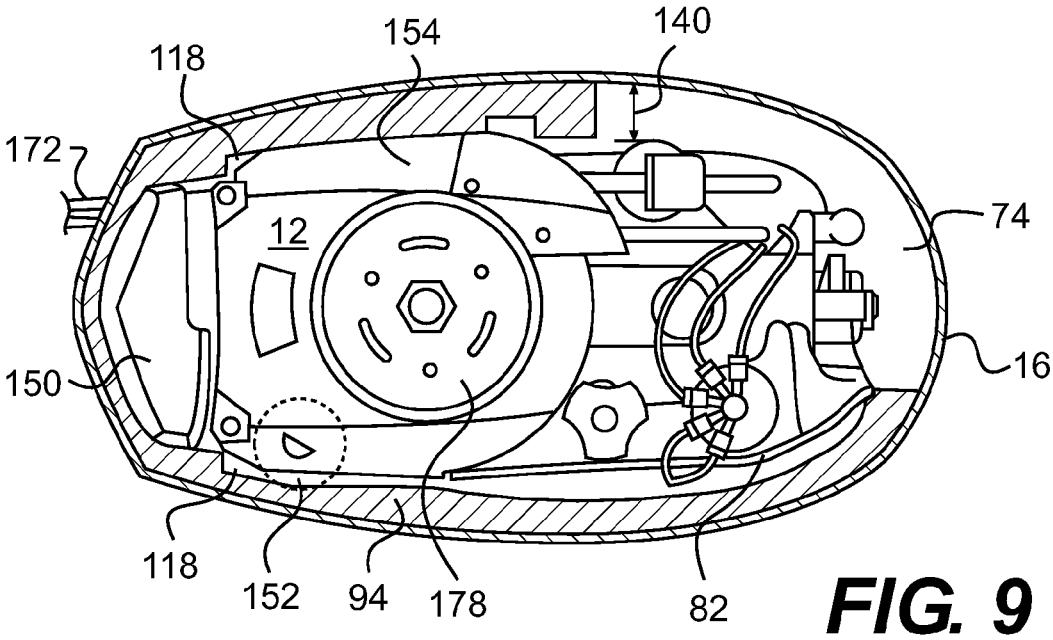
FIG. 9 is a cross-sectional view of the outboard motor of FIG. 1 taken along line 9-9 of FIG. 2.

As shown in FIG. 9, silencer 94 is positioned in close proximity to oil reservoir 82, a portion of starter 152, air intake 150 and shroud 154. Thickness 140 varies as silencer 94 extends about engine 12. Gap 118 is variable and is formed between engine 12 and silencer 94 in those areas where it is preferred or impractical for silencer 94 to be in contact with engine 12. Areas of engine 12 have adjacent components, which when the contour of the components is combined, form a recess. Cover 16 with silencer 94 attached therein is slidingly related to these components. Depending on the angle of approach of the cover to the motor, silencer 94 can be constructed to accommodate these recesses.

Figure 10:
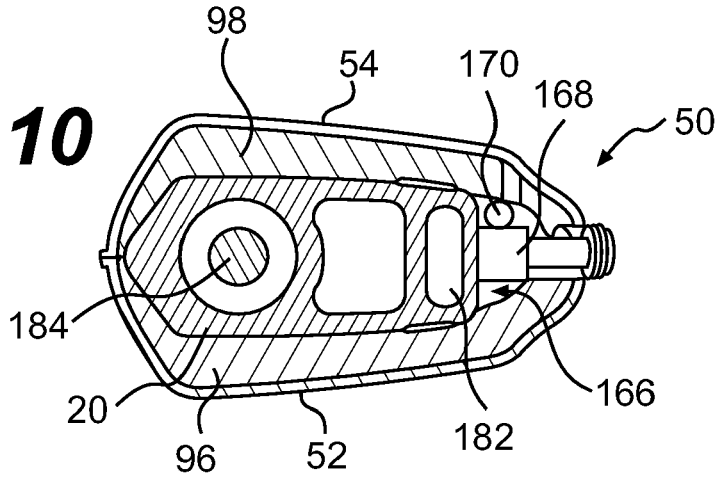
FIG. 10 is a cross-sectional view of the outboard motor of FIG. 1 taken along line 10-10 of FIG. 2.
Figure 11:
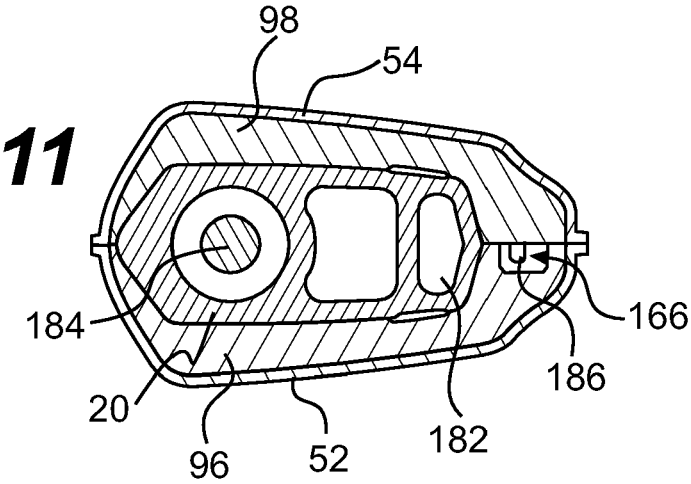
FIG. 11 is a cross-sectional view of the outboard motor of FIG. 1 taken along line 11-11 of FIG. 2.

FIGS. 10 and 11 show midsection 20 with covers 52 and 54 positioned thereabout. Covers 52 and 54 with silencers 96 and 98 disposed therein are snuggly positioned about midsection 20. Recess 166 has idle relief muffler 168 and cooling system tell-tale 170 positioned therein. An exhaust passage 182 extends through midsection 20 and is in fluid communication with idle relief muffler 168. Idle relief muffler 168 discharges the engine exhaust gas through housing 50 and above a waterline of operation during idle operation of engine 12. Idle relief muffler 168 relieves exhaust system pressure to optimize idle operation of engine 12. A drive shaft 184 extends through midsection 20 and connects engine 12 to a propeller. Referring to FIG. 11, recess 166 constricts as it proceeds down midsection 20 toward a waterline of operation. A drain hole 186 passes from recess 166 and vents to atmosphere. Any water that may infiltrate housing 50 collects in recess 166 and drains from the inside of housing 50 via drain hole 186.

Figure 12:
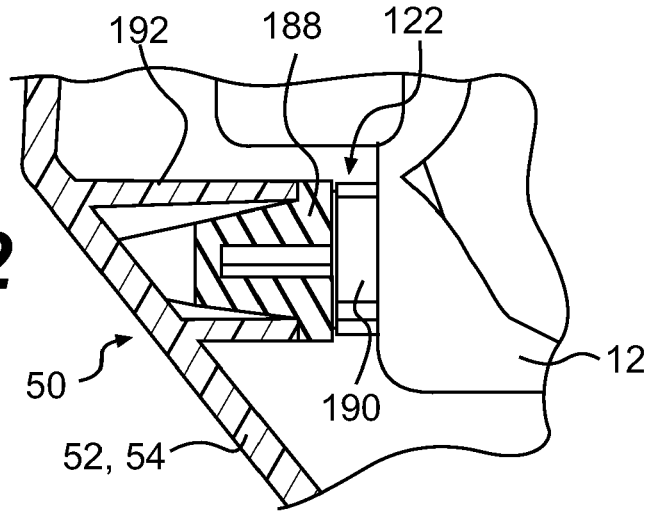
FIG. 12 is a cross-sectional view of an indexing boss of the outboard motor shown in FIG. 4 taken along detail 11-11 of FIG. 4.

The engagement between lower motor covers 52, 54 and indexing post 122 is shown in FIG. 12. A rubber bushing 188 is connected to a boss 190 integrally formed with engine 12. Cover 52, 54 has an extension 192 extending therefrom constructed to engage rubber-bushing 188. Rubber bushing 188 reduces the amount of engine vibration allowed to propagate from engine 12 directly to cover 52, 54. Such an orientation enhances the acoustical separation between engine 12 and housing 50.

Silencers 94, 96, and 98 are shown in FIGS. 13 through 15. Contour 134 of silencer 94 substantially corresponds to a contour of a housing positioned thereabout. Contour 120 substantially corresponds to a contour of an engine disposed in recess 136. Such a construction effectively acoustically encapsulates an engine positioned therein. Contour 142 of silencers 96 and 98 is constructed to substantially match a contour of a housing positioned thereabout and contour 144 is constructed to substantially match a contour of a midsection disposed therebetween. Silencers 94, 96, and 98 effectively acoustically encapsulate an outboard motor disposed therein. Such an outboard motor effectively attenuates and directs engine noise before it can exit the housing and be perceived by an operator or persons nearby.

Figure 16:
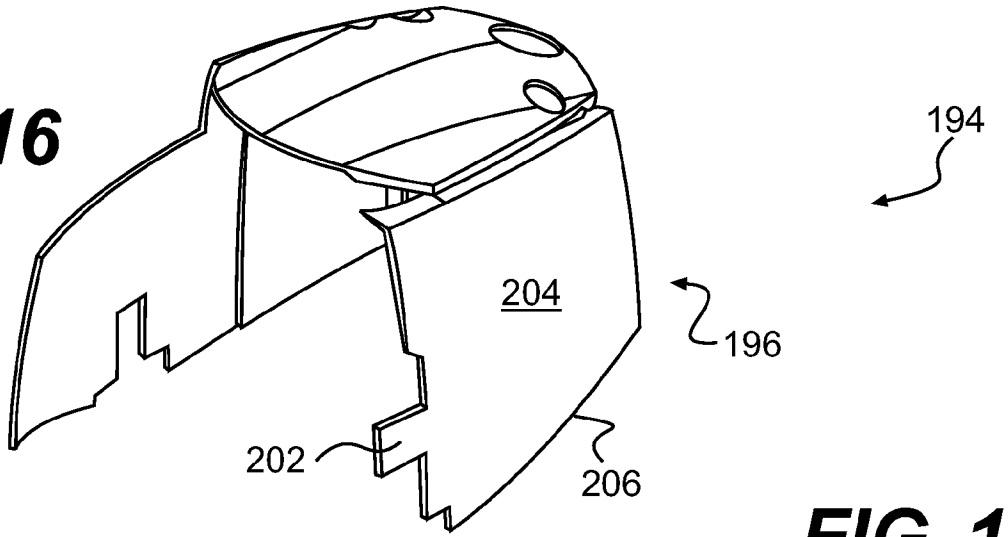
FIGS. 16-18 are perspective views of an alternate embodiment of the vibro-acoustic treatments shown in FIGS. 13-15 for use with an outboard motor.
Figure 18:
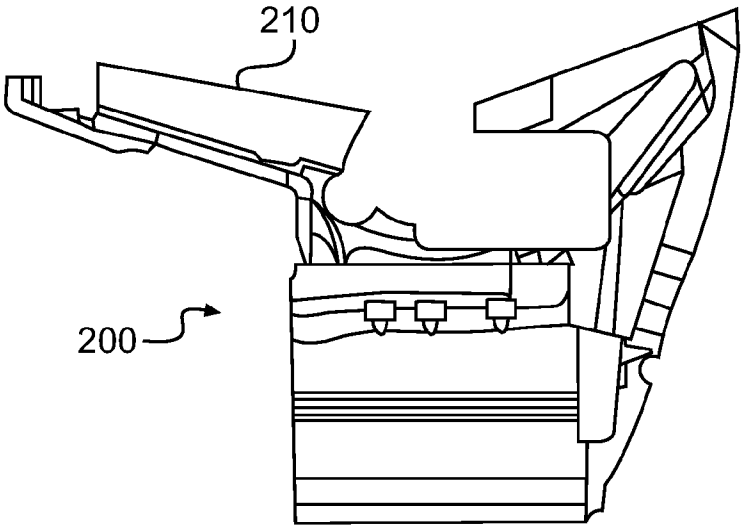
Figure 17:
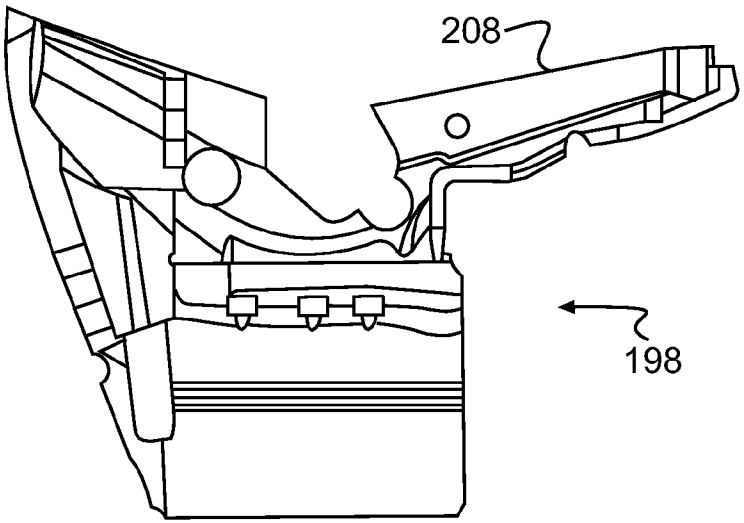

Silencers 94, 96, and 98 are molded to maximize the amount of sound attenuating and vibration arresting material that can be placed in the cavity between an engine and a housing. FIGS. 16, 17, and 18 show an alternate silencer assembly 194. The individual components of the silencer assembly are molded to substantially match the contour of a housing they are position in and a motor they are positioned about. Silencer assembly 194 includes an upper silencer 196, shown in FIG. 16, a port silencer 198, shown in FIG. 17, and a starboard silencer 198, shown in FIG. 18. Silencer 196 has a tab 202 that extends from a body 204 thereof. A lower edge 206 of silencer 196 is constructed to engage an upper edge 208 of silencer 198, shown in FIG. 17, and an upper edge 210 of silencer 200, shown in FIG. 18. Silencer 198, shown in FIG. 17, is constructed to snuggly engage a port side of a midsection and a lower portion of a powerhead with a lower motor cover positioned thereabout. Silencer 200, shown in FIG. 18, is constructed similar to silencer 198 and is constructed to be positioned about a starboard side of the motor and connect to silencer 198. Such a construction forms an outboard motor having a noticeable reduction in perceived noise generation.

Regardless of which silencer assembly is practiced, an outboard motor equipped with either silencer assembly or a variation thereof will realize considerable sound attenuation. Operation of an outboard motor equipped with a vibro-acoustic treatment according to the present invention has sound emissions of approximately 55 decibels when the motor is operated at approximately 500 RPM. As the speed of the engine is increased to approximately 2300 RPM, the level of sound emitted therefrom increases to approximately 75 decibels. Increasing engine speed to approximately 3450 RPM yields sound levels of approximately 79 decibels while engine speeds of approximately 4000 RPM yields sound levels of approximately 83 decibels. Engine speeds of approximately 4600 RPM yields sound levels of approximately 83 decibels, while engine speeds of approximately 5400 RPM yield sound levels of approximately 89 decibels. As engine speed increases to approximately 5800 RPM, sound levels of approximately 92 decibels are emitted therefrom. This is but one example of amounts of noise emitted from the motor. It is understood that the molded silencer can be tuned to attenuate a specific frequency during a specific range of operation of the engine by altering the composition, thickness, and/or orientation of the molded silencer to an engine for use therewith.

The present invention provides a silencer and method of silencing an outboard motor that minimizes the transmission of noise beyond the motor. The silencer is molded to substantially match the shape of a volume between an engine and a cover. Such a construction provides a one-piece molded silencer that absorbs noise emitted from the engine.

Therefore, in accordance with one embodiment of the present invention, a motor silencer includes a molded composition having a first surface and a second surface. The first surface has a contour that substantially matches a contour of a cover of the motor and the second surface has a contour that conforms about internal components of the motor. Such a construction forms a motor silencer that absorbs noise generated by the motor.

According to another embodiment of the present invention, an outboard motor includes a midsection having at least one midsection cover. The midsection cover has a first contour defining a first volume between the midsection and the midsection cover. A first silencer fills a majority of the first volume. A second silencer is disposed in a second volume between an engine and an engine cover and is molded to substantially match a contour of the cover. Such a construction prevents a majority of the noise generated by the engine during low operating speeds from passing beyond the covers.

In accordance with a further embodiment of the present invention, a method of silencing an outboard motor includes providing a housing having a cover and at least one lower unit cover each being engagable on an outboard motor and providing a silencer molded to substantially match the shape of the cover and constructed to absorb and contain sound emitted from the motor.

In accordance with another embodiment of the present invention, an outboard motor includes an engine attached to a midsection. A cover is disposed about the engine and encloses a volume therebetween. A vibro-acoustic barrier is disposed within the volume and molded to substantially match a shape of the volume. Such a construction minimizes the transmission of noise from outboard motor.

In accordance with yet a further embodiment of the present invention, an outboard motor includes an upper motor cover disposed about an engine and a lower motor cover disposed about a midsection and forming a volume therebetween. A molded lower silencer having a shape that substantially matches a shape of the volume is disposed therein. Such a construction minimizes the transmission of noise emitted from the midsection beyond the lower motor cover.

While the present invention is shown as being incorporated into an outboard motor, the present invention is equally applicable with many other applications, which have an engine disposed within a housing, some of which include inboard motors, snowmobiles, personal watercrafts, all-terrain vehicles (ATVs), motorcycles, mopeds, lawn and garden equipment, generators, etc.

The present invention has been described in terms of the preferred embodiment, and it is recognized that equivalents, alternatives, and modifications, aside from those expressly stated, are possible and within the scope of the appending claims.

What is claimed is:

1. An outboard motor comprising:

a rigid midsection having at least one midsection cover;

the midsection cover having a first contour, a first volume defined between the midsection and the midsection cover;

a first silencer filling a majority of the first volume;

an engine supported on the midsection;

an engine cover having a second contour, a second volume defined between the engine and the engine cover; and a second silencer disposed in the second volume between the engine and the engine cover and shaped to substantially match a contour of the engine.

2. The outboard motor of claim 1 wherein the first silencer is comprised of a material having a density that is greater than a density of a material of the second silencer.

3. The outboard motor of claim 2 wherein the density of the material of the first silencer is at least fourteen pounds per cubic foot.

4. The outboard motor of claim 2 wherein the density of the material of the second silencer is at least two pounds per cubic foot.

5. The outboard motor of claim 1 wherein the second silencer further comprises a recess having a contour that generally matches the contour of the engine.

6. The outboard motor of claim 5 wherein a gap between the second silencer and the engine is non uniform.

7. The outboard motor of claim 1 wherein the first and the second silencer are waterproof.

8. The outboard motor of claim 7 wherein the first silencer is more waterproof than the second silencer.

9. The outboard motor of claim 1 further comprising a second midsection cover having a contour, a third volume defined between the second midsection cover and the midsection and having a third silencer disposed therein.

10. The outboard motor of claim 9 wherein the third silencer has a contour that substantially matches a contour of the third volume.

11. The outboard motor of claim 10 wherein the third silencer is comprised of a material having a density that is greater than a density of the second silencer.

12. The outboard motor of claim 1 incorporated into a watercraft.

13. The outboard motor of claim 1 wherein the outboard motor emits approximately 83 decibels while operated at approximately 4600 RPM.

14. The outboard motor of claim 1 wherein the outboard motor emits approximately 89 decibels while operated at approximately 5400 RPM.

15. The outboard motor of claim 1 wherein the outboard motor emits approximately 55 decibels while operated at approximately 500 RPM.

16. The outboard motor of claim 1 wherein the outboard motor emits approximately 79 decibels while operated at approximately 3450 RPM.

17. An outboard motor comprising:

a midsection configured to be mounted on a transom of a boat;

an engine supported on the midsection;

a gear case connected below the midsection;

a propeller shaft housed in the gear case and operatively connected to the engine;

a propeller driven by the engine via the propeller shaft to propel the boat;

a cover disposed about the engine and enclosing a volume therebetween, an inner surface of the cover and an outer surface of the engine together defining a shape of the volume; and a vibro-acoustic treatment occupying a majority of the volume and shaped to substantially match internal and external contours of the volume.

18. The outboard motor of claim 17 further comprising a first lower unit cover constructed to enclose a portion of the midsection and define a volume therebetween.

19. The outboard motor of claim 18 further comprising another vibro-acoustic treatment shaped to substantially match the volume between the first lower unit cover and the midsection.

20. The outboard motor of claim 19 further comprising a second lower unit cover constructed to enclose another portion of the midsection and defining a volume therebetween and a third vibro-acoustic treatment shaped to substantially match the volume between the second lower unit and the midsection.

21. The outboard motor of claim 20 wherein the midsection is circumferentially enclosed by the vibro-acoustic treatments positioned thereabout.

22. The outboard motor of claim 17 wherein the vibro-acoustic treatment is integrally formed and has an exterior surface that has a density that is greater than a density of an interior surface.

23. The outboard motor of claim 22 wherein the exterior surface of the vibro-acoustic treatment is non-absorbent.

24. The outboard motor of claim 17 wherein the vibro-acoustic treatment has an average density of at least two pounds per cubic foot.

25. An outboard motor comprising:

a midsection configured to be mounted on a transom of a boat;

an engine supported on the midsection;

a sear case connected below the midsection;

a propeller shaft housed in the gear case and operatively connected to the engine;

a propeller driven by the engine via the propeller shaft to propel the boat;

an upper motor cover disposed about the engine;

a lower motor cover disposed about the midsection and forming a volume therebetween, an inner contour of the lower motor cover and an outer contour of the midsection together defining a shape of the volume; and a shaped lower silencer occupying substantially the entire volume and matching the outer contour of the midsection.

26. The outboard motor of claim 25 further comprising another lower motor cover disposed about the midsection and enclosing a volume therebetween.

27. The outboard motor of claim 26 further comprising another shaped lower silencer having a shape that substantially matches a shape of the volume between the another lower cover and the midsection.

28. The outboard motor of claim 25 wherein the shaped lower silencer has a density of approximately twenty-two pounds per cubic foot.

29. The outboard motor of claim 25 further comprising a shaped upper silencer having a shape that substantially matches a shape of a volume between the upper motor cover and the engine.

30. The outboard motor of claim 29 wherein the shaped upper silencer has a density of at least four pounds per cubic foot.

31. An outboard motor comprising:

a midsection configured to be mounted on a transom of a boat;

an engine supported on the midsection;

a gear case connected below the midsection;

a propeller shaft housed in the gear case and operatively connected to the engine;

a propeller driven by the engine via the propeller shaft to propel the boat;

at least one midsection cover disposed around the midsection, the midsection cover having a first contour;

a first volume defined between the midsection and the midsection cover;

a first silencer disposed in the first volume, the first silencer being snugly positioned about the midsection, the first silencer filling a majority of the first volume;

an engine cover having a second contour, a second volume defined between the engine and the engine cover; and a second silencer disposed in the second volume between the engine and the engine cover and shaped to substantially match a contour of the engine.

32. An outboard motor comprising:

a midsection configured to be mounted on a transom of a boat, the midsection having an exhaust housing;

an engine supported on the midsection;

a gear case connected below the midsection;

a propeller shaft housed in the gear case and operatively connected to the engine;

a propeller driven by the engine via the propeller shaft to propel the boat;

at least one midsection cover disposed around the midsection, the at least one midsection cover having a first contour;

a first volume defined between the exhaust housing and the midsection cover;

a first silencer disposed in the first volume, the first silencer filling a majority of the first volume;

an engine cover having a second contour, a second volume defined between the engine and the engine cover; and a second silencer disposed in the second volume between the engine and the engine cover and shaped to substantially match a contour of the engine.

* * * * *

UNITED STATES PATENT AND TRADEMARK OFFICE

CERTIFICATE OF CORRECTION

PATENT NO. : 7,485,019 B1
APPLICATION NO. : 10/708085
DATED : February 3, 2009
INVENTOR(S) : James F. Macier, George L. Broughton and Evelyn A. Breznik It is certified that error appears in the above-identified patent and that said Letters Patent is hereby corrected as shown below:

In Column 10, Line (50) a sear case, should read -- a gear case --

Signed and Sealed this

Thirty-first Day of March, 2009

JOHN DOLL
*Acting Director of the United States Patent and Trademark Office*